US010960245B2

(12) United States Patent
Tarahomi et al.

(10) Patent No.: US 10,960,245 B2
(45) Date of Patent: Mar. 30, 2021

(54) FLAME MITIGATION DEVICE FOR A PORTABLE FUEL CONTAINER

(71) Applicant: TPG Plastics LLC, Willowbrook, IL (US)

(72) Inventors: Sassan Tarahomi, Brighton, MI (US); Arash Kiani, Upper Saddle River, NJ (US); Saquib Toor, Glenview, IL (US); Chibuzor D. Ezeamaku, Wheaton, IL (US); Justin T. Stetler, Joliet, IL (US); Manikanta R. Kurri, Lisle, IL (US)

(73) Assignee: TPG Plastics LLC, Willowbrook, IL (US)

( * ) Notice: Subject to any disclaimer, the term of this patent is extended or adjusted under 35 U.S.C. 154(b) by 8 days.

(21) Appl. No.: 16/280,478

(22) Filed: Feb. 20, 2019

(65) Prior Publication Data

US 2020/0261756 A1 Aug. 20, 2020

(51) Int. Cl.
*A62C 3/06* (2006.01)
*A62C 4/00* (2006.01)

(52) U.S. Cl.
CPC ..... *A62C 3/065* (2013.01); *A62C 4/00* (2013.01)

(58) Field of Classification Search
CPC ..... A62C 3/065; A62C 4/00; B65D 25/385; B65D 90/28
USPC ..... 220/88.1, 88.2
See application file for complete search history.

(56) References Cited

U.S. PATENT DOCUMENTS

2012/0273485 A1* 11/2012 Lapoint, III ..... B65D 77/061 220/7
2015/0251030 A1* 9/2015 Elias ..... A62C 3/065 220/88.2
2016/0361581 A1 12/2016 Riordan
2017/0266474 A1 9/2017 Elias et al.

OTHER PUBLICATIONS

Catalog page for "Flexo Pet", techflex.com, https://cdn.techflex.com/assets/pdfs/catalog/pet.pdf (last downloaded Feb. 20, 2019).

* cited by examiner

*Primary Examiner* — Jeffrey R Allen
(74) *Attorney, Agent, or Firm* — Christopher G. Darrow; Darrow Mustafa PC

(57) ABSTRACT

A portable fuel container includes a fuel reservoir and an access port therefor, and an elongate flame mitigation device in the fuel reservoir behind the access port. The flame mitigation device includes an open mouth sealed around the access port, a closed bottom opposing the mouth, and an intermediate tubular sidewall. In addition, the flame mitigation device has a woven construction. In relation to the woven construction, the flame mitigation device includes inelastically resiliently flexible interwoven warps and wefts. Moreover, the flame mitigation device interstitially defines quenching openings between the warps and the wefts configured to allow liquid fuel therethrough, but prevent air-fuel mixtures ignited as flames from propagating therethrough. Moreover, the flame mitigation device is elastically flexible to hold its shape, but elastically flex under manual manipulation.

20 Claims, 3 Drawing Sheets

FLAME MITIGATION DEVICE FOR A PORTABLE FUEL CONTAINER

TECHNICAL FIELD

The embodiments disclosed herein relate to portable fuel containers and, more particularly, to flame mitigation devices for portable fuel containers, and portable fuel containers with flame mitigation devices.

BACKGROUND

Standard consumer-grade handheld portable fuel containers (or PFCs) include fuel reservoirs and access ports therefor. Some portable fuel containers also include flame mitigation devices (or FMDs) for preventing air-fuel mixtures ignited as flames about the access ports from igniting air-fuel mixtures in the fuel reservoirs.

SUMMARY

Disclosed herein are embodiments of a flame mitigation device for a portable fuel container, and a portable fuel container with a flame mitigation device. In one aspect, a portable fuel container includes a fuel reservoir and an access port therefor, and an elongate flame mitigation device in the fuel reservoir behind the access port. The flame mitigation device includes an open mouth sealed around the access port, a closed bottom opposing the mouth, and an intermediate tubular sidewall. In addition, the flame mitigation device has a woven construction. In relation to the woven construction, the flame mitigation device includes inelastically resiliently flexible interwoven warps and wefts. Moreover, the flame mitigation device interstitially defines quenching openings between the warps and the wefts configured to allow liquid fuel therethrough, but prevent air-fuel mixtures ignited as flames from propagating therethrough. Moreover, the flame mitigation device is elastically flexible to hold its shape, but elastically flex under manual manipulation.

In another aspect, a portable fuel container includes a fuel reservoir and an access port therefor, an adaptor neck around the access port, and an elongate flame mitigation device in the fuel reservoir behind the access port. The adaptor neck extends from the fuel reservoir with an oblique orientation. The flame mitigation device includes an open mouth coaxially inside the adaptor neck and permanently connected thereto circumferentially therearound, by which the flame mitigation device is suspended in the fuel reservoir in-line with the adaptor neck, a closed bottom opposing the mouth, and an intermediate tubular sidewall. In addition, the flame mitigation device has a woven construction. In relation to the woven construction, the flame mitigation device includes inelastically resiliently flexible interwoven warps and wefts. Moreover, the flame mitigation device interstitially defines quenching openings between the warps and the wefts configured to allow liquid fuel therethrough, but prevent air-fuel mixtures ignited as flames from propagating therethrough. Moreover, the flame mitigation device is elastically flexible to hold itself in-line with the adaptor neck, hold itself from having the sidewall pinch and hold the quenching openings open, but elastically expand and elastically bend under manual manipulation while holding the quenching openings thereagainst from closing enough to prevent liquid fuel therethrough, or opening enough to allow air-fuel mixtures ignited as flames from propagating therethrough.

In yet another aspect, a flame mitigation device for a portable fuel container includes a woven construction born from a precursor woven tubular blank. The blank includes inelastically resiliently flexible interwoven warps and wefts. As fashioned into the flame mitigation device, the blank is left open at a first end to form a mouth having an annular cross-sectional shape, is permanently pinched closed at a second end to form a bottom having a pinched cross-sectional shape, and is left at an intermediate remainder to form a sidewall having a progressively narrowing oval cross-sectional shape. In relation to the woven construction, the flame mitigation device includes the warps and the wefts. Moreover, the flame mitigation device interstitially defines quenching openings between the warps and the wefts configured to allow liquid fuel therethrough, but prevent air-fuel mixtures ignited as flames from propagating therethrough. Moreover, the flame mitigation device is elastically flexible to hold its shape, but elastically flex under manual manipulation.

These and other aspects will be described in additional detail below.

BRIEF DESCRIPTION OF THE DRAWINGS

The various features, advantages and other uses of the present embodiments will become more apparent by referring to the following detailed description and drawing in which.

DETAILED DESCRIPTION

In relation to a portable fuel container that includes a fuel reservoir and an access port therefor, this disclosure teaches a flame mitigation device for preventing air-fuel mixtures ignited as flames about the access port from igniting air-fuel mixtures in the fuel reservoir. The flame mitigation device has a woven construction. In relation to the woven construction, the flame mitigation device includes inelastically resiliently flexible interwoven warps and wefts, interstitially defines quenching openings between the warps and the wefts, and is elastically flexible. The quenching openings allow liquid fuel therethrough, but prevent air-fuel mixtures ignited as flames from propagating therethrough.

The flame mitigation device has advantageous user friendliness, including elastically flexing in association with accepting standard fuel pump nozzles into the fuel reservoir inside the flame mitigation device. Moreover, the flame mitigation device has advantageous manufacturability, including being cost-effectively fashioned from a simple woven tubular blank, and being straightforwardly installable to the otherwise assembled portable fuel container. Another advantage of the flame mitigation device is that despite its advantageous user friendliness and advantageous manufacturability, basic performance requirements are not compromised.

Figure 1A:
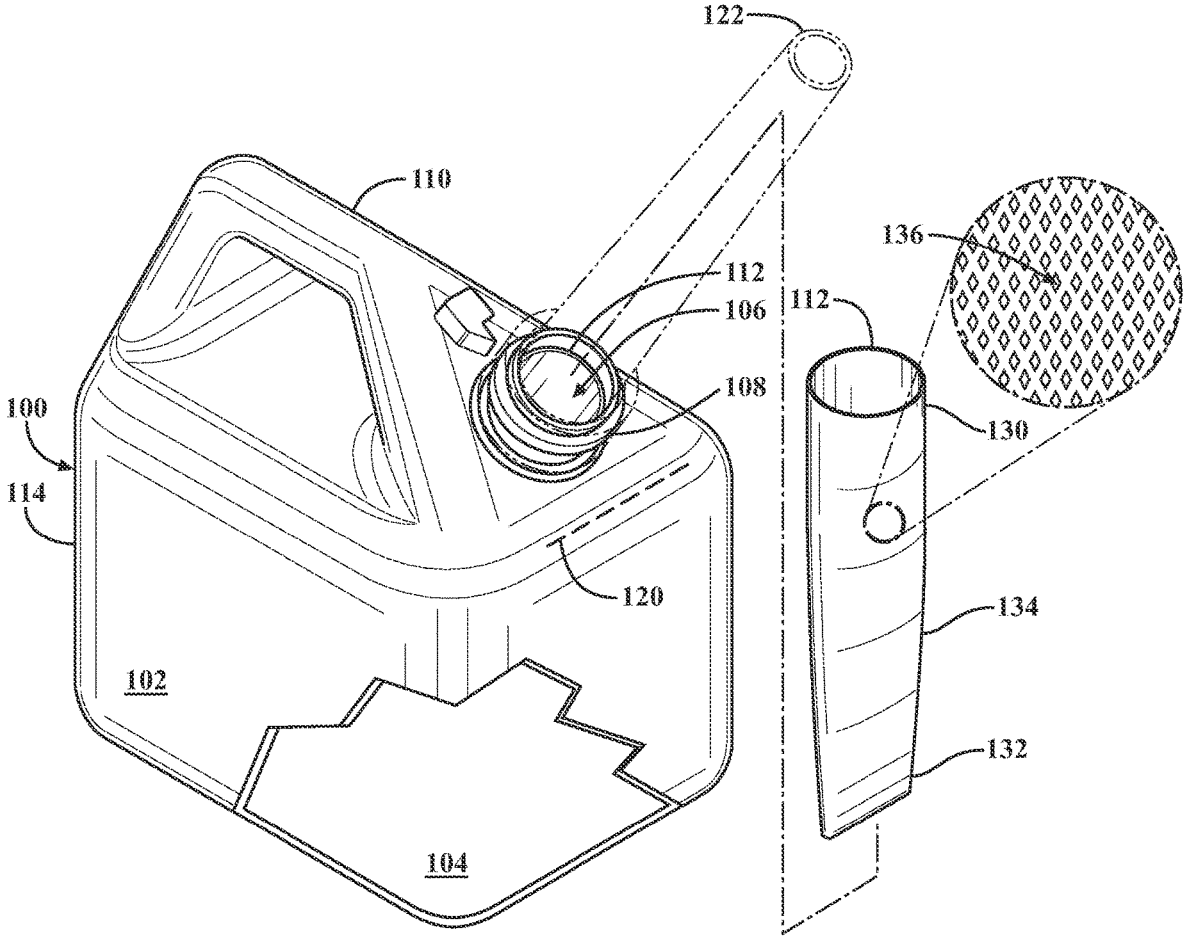
FIG. 1A is a perspective view of a portable fuel container with a flame mitigation device, showing a hollow body, a fuel reservoir and an access port therefor defined by the hollow body, with the hollow body partially broken away to reveal the fuel reservoir, an adaptor neck formed by the hollow body around the access port, and the flame mitigation device in the fuel reservoir behind the access port, with the flame mitigation device additionally shown apart from the remainder of the portable fuel container for better viewing.

A representative consumer-grade handheld portable fuel container (or PFC) 100 is shown in FIG. 1A. The portable fuel container 100 includes an exterior 102, and an internal fuel reservoir 104 for storing liquid fuel, and housing air-fuel mixtures associated therewith. In relation to the fuel reservoir 104, the portable fuel container 100 also includes an access port 106 therefor for dispensing liquid fuel from the fuel reservoir 104, and filling the fuel reservoir 104 with liquid fuel. The portable fuel container 100 also includes an external adaptor neck 108 for mounting external accessories over the access port 106, and an external handle 110 for handling the portable fuel container 100. It is contemplated that if users ignore warnings and mishandle the portable fuel container 100 by bringing it near sources of flames, air-fuel mixtures about the access port 106 might be ignited as flames. In anticipation thereof, the portable fuel container 100 also includes an internal flame mitigation device (or FMD) 112 behind the access port 106 for preventing air-fuel mixtures ignited as flames about the access port 106 from igniting air-fuel mixtures in the fuel reservoir 104.

The portable fuel container 100 includes a substantially closed rigid vessel-like hollow body 114. The hollow body 114 is generally cuboid, and includes a bottom and an opposing top, and four intermediate upright sides. The construction of the portable fuel container 100 is based on the hollow body 114. Specifically, the hollow body 114 forms the exterior 102, defines the fuel reservoir 104, and defines the access port 106. Moreover, the hollow body 114 forms the adaptor neck 108, and forms the handle 110. Moreover, the hollow body 114 supports external accessories, and supports the flame mitigation device 112.

The hollow body 114 has a blow-molded or otherwise unitary whole construction. Moreover, the hollow body 114 is made from one or more high-strength, durable, chemically fuel-resistant and non-emissive polymeric materials. For instance, the hollow body 114 may be made from one or more thermoplastics suitable for blow molding, such as high-density polyethylene (HDPE).

The fuel reservoir 104 is generally closed. The fuel reservoir 104 is configured to store liquids, including liquid fuel. For instance, the fuel reservoir 104 may be configured to store gasoline, diesel fuel, kerosene or the like. Relatedly, the fuel reservoir 104 has a capacity or, in other words, the maximum amount of liquid fuel the fuel reservoir 104 is configured to store. For instance, the portable fuel container 100 may have a capacity of one gallon, two gallons, five gallons or the like. Moreover, the fuel reservoir 104 has a fill level 120 or, in other words, the level of liquid fuel in the fuel reservoir 104 when filled to capacity therewith when the portable fuel container 100 makes untipped ground contact. In addition to being configured to store liquid fuel, the fuel reservoir 104 is configured to house gasses, including, in association with liquid fuel, air-fuel mixtures, in the headspace above liquid fuel.

As defined by the hollow body 114, the access port 106 has a circular cross-sectional shape, and opens between the fuel reservoir 104 and the exterior 102 through the hollow body 114. The access port 106 is raised atop the fuel reservoir 104 and, from its raised location atop the fuel reservoir 104, opens above the fill level 120. The adaptor neck 108 is formed by the hollow body 114 around the access port 106. The adaptor neck 108 has an annular cross-sectional shape, with the same cross-sectional dimensions as the access port 106, and from its location around the access port 106, opens between the fuel reservoir 104 and the exterior 102 around the access port 106. With the access port 106 raised atop the fuel reservoir 104, the adaptor neck 108 is located atop the fuel reservoir 104 and, from its location atop the fuel reservoir 104, opens above the fill level 120. Moreover, the adaptor neck 108 extends from the fuel reservoir 104 with a forward-facing oblique orientation.

The adaptor neck 108 is configured as an interface for mounting external accessories to the hollow body 114 thereat, whereupon they become an included removable part of the portable fuel container 100, and form the exterior 102 together with the hollow body 114. Specifically, in relation to being formed by the hollow body 114 around the access port 106, the adaptor neck 108 is configured as an interface for mounting accessories over the access port 106. For instance, as shown, the portable fuel container 100 includes a spout 122 mounted to the hollow body 114 at the adaptor neck 108 over the access port 106. In a screw configuration, the adaptor neck 108 is externally threaded. Relatedly, with the spout 122 being internally threaded, the adaptor neck 108 is configured as an interface for screwing the spout 122 and other internally threaded accessories. Additionally, or alternatively, the adaptor neck 108 could be configured as an interface for any combination of snapping, hooking, locking and otherwise mounting the spout 122 and other accessories.

The spout 122 is tubular, with the same or otherwise similar cross-sectional dimensions as the adaptor neck 108, and from its location over the access port 106, opens between the fuel reservoir 104 and the exterior 102 over the access port 106. Although the spout 122 opens between the fuel reservoir 104 and the exterior 102, it will be understood that this disclosure is not exclusive to the spout 122 requiring manual actuation as a condition thereto, and otherwise automatically closing between the fuel reservoir 104 and the exterior 102. With the adaptor neck 108 located atop the fuel reservoir 104, the spout 122 is located atop the fuel reservoir 104 and, from its location atop the fuel reservoir 104, opens above the fill level 120. Moreover, with the adaptor neck 108 extending from the fuel reservoir 104 with a forward-facing oblique orientation, the spout 122 extends from the fuel reservoir 104 with a forward-facing oblique orientation as an extension of the adaptor neck 108.

The handle 110 is elongate, and extends along the fuel reservoir 104. The handle 110 is raised atop the fuel reservoir 104 and, from its raised location atop the fuel reservoir 104, extends along the fuel reservoir 104 with an upward-facing lengthwise orientation. The handle 110 is configured as an interface for any combination of picking up, holding, carrying, tipping, setting down and otherwise handling the portable fuel container 100.

Figure 1B:
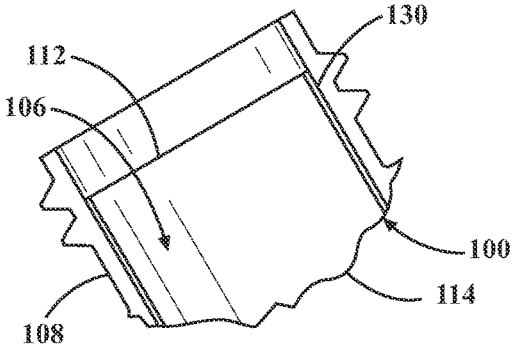
FIG. 1B is a partial cross-sectional view of the portable fuel container across the adaptor neck, showing the flame mitigation device being connected to the adaptor neck.

As shown with additional reference to FIG. 1B, the flame mitigation device 112 is connected to the hollow body 114 at the adaptor neck 108 behind the access port 106. The flame mitigation device 112 is elongate and trap-like, with the same or otherwise similar cross-sectional dimensions as the adaptor neck 108, and from its location behind the access port 106, interfaces between the fuel reservoir 104 and the exterior 102 behind the access port 106. With the adaptor neck 108 located atop the fuel reservoir 104, the flame mitigation device 112 is located in the fuel reservoir 104 and, from its location in the fuel reservoir 104, interfaces across the fill level 120. Moreover, with the adaptor neck 108 extending from the fuel reservoir 104 with a forward-facing oblique orientation, the flame mitigation device 112 extends into the fuel reservoir 104 with a rearward-facing oblique orientation in-line with the adaptor neck 108.

Along its length, the flame mitigation device 112 includes an open mouth 130 sealed around the access port 106, by which the flame mitigation device 112 is suspended from the remainder of the portable fuel container 100 in the fuel reservoir 104, a closed bottom 132 opposing the mouth 130, and an intermediate tubular sidewall 134. Moreover, the flame mitigation device 112, including along the sidewall 134, defines multiple quenching openings 136 for allowing liquid fuel therethrough, but preventing air-fuel mixtures ignited as flames from propagating therethrough.

Along the mouth 130, the flame mitigation device 112 has an annular cross-sectional shape, with the same cross-sectional dimensions as the adaptor neck 108, and is coaxially inside the adaptor neck 108. The flame mitigation device 112 is connected by the mouth 130 to the adaptor neck 108 as an included irremovable part of the portable fuel container 100. Specifically, from its location coaxially inside the adaptor neck 108, the mouth 130 is permanently connected to the adaptor neck 108 circumferentially therearound, and thereby sealed around the access port 106. In relation to its location coaxially inside the adaptor neck 108, the mouth 130 is set coaxially inside the adaptor neck 108 at a depth to avoid interference with the spout 122 or other accessories mounted thereto. The flame mitigation device 112, including along the sidewall 134 and at the bottom 132, is not otherwise supported by the remainder of the portable fuel container 100, including the hollow body 114. Accordingly, the flame mitigation device 112 is suspended from the adaptor neck 108 in the fuel reservoir 104 by the mouth 130.

At the bottom 132, the flame mitigation device 112 has a pinched cross-sectional shape, with the same or otherwise similar major cross-sectional dimensions as the adaptor neck 108. Along the sidewall 134, the flame mitigation device 112 has an oval cross-sectional shape, with the same or otherwise similar major cross-sectional dimensions as the adaptor neck 108, and is axially aligned with the adaptor neck 108. Specifically, transitioning from the annular cross-sectional shape along the mouth 130 to the pinched cross-sectional shape at the bottom 132, the flame mitigation device 112 has a progressively narrowing oval cross-sectional shape.

As defined by the flame mitigation device 112, the quenching openings 136 open through the flame mitigation device 112. Moreover, from the perspective of the portable fuel container 100, the quenching openings 136 open between the fuel reservoir 104 and the exterior 102 behind the access port 106. With the flame mitigation device 112 located in the fuel reservoir 104 and interfacing across the fill level 120, the quenching openings 136 are located in the fuel reservoir 104 and, from their locations in the fuel reservoir 104, open both below the fill level 120 and above the fill level 120.

In relation to the quenching openings 136, the flame mitigation device 112 is pervious to liquids, including liquid fuel. Specifically, the quenching openings 136 are individually and, by extension, together, configured to allow liquid fuel therethrough. Relatedly, the flame mitigation device 112 is configured to allow liquid fuel past the flame mitigation device 112 through the quenching openings 136. Similarly, from the perspective of the portable fuel container 100, the flame mitigation device 112 is configured to allow liquid fuel between the fuel reservoir 104 and the exterior 102 through the access port 106 and past the flame mitigation device 112 through the quenching openings 136.

Among other things, it follows that using the access port 106, the spout 122 and the quenching openings 136, the portable fuel container 100 defines a fluid passageway between the fuel reservoir 104 and the exterior 102, including not only through the access port 106 and through the spout 122, but also past the flame mitigation device 112 through the quenching openings 136. Moreover, using the adaptor neck 108 and the flame mitigation device 112, and in conjunction with defining the fluid passageway, the portable fuel container 100 defines a spatial passageway between the fuel reservoir 104 and the exterior 102, including through the adaptor neck 108 and inside the flame mitigation device 112. In relation to the spatial passageway, the same cross-sectional dimensions of the adaptor neck 108 and the flame mitigation device 112 along the mouth 130 are larger than the cross-sectional dimensions of standard fuel pump nozzles.

For purposes of dispensing liquid fuel from the fuel reservoir 104, with the spout 122 mounted over the access port 106, the portable fuel container 100 is tippable toward the access port 106 to the point where liquid fuel in the fuel reservoir 104 is brought above the fill level 120. In association with being brought above the fill level 120, liquid fuel in the fuel reservoir 104 will be dispensed therefrom past the flame mitigation device 112 through the quenching openings 136, through the access port 106 and through the spout 122. For purposes of filling the fuel reservoir 104 with liquid fuel, with the spout 122 removed, standard fuel pump nozzles are acceptable into the fuel reservoir 104 through the adaptor neck 108 and inside the flame mitigation device 112. In association with standard fuel pump nozzles dispensing liquid fuel inside the flame mitigation device 112, the fuel reservoir 104 will be filled therewith past the flame mitigation device 112 through the quenching openings 136.

In relation to the quenching openings 136, in addition to being pervious to liquid fuel, the flame mitigation device 112 is impervious to flames and, more particularly, to air-fuel mixtures ignited as flames. Specifically, the quenching openings 136 are individually and, by extension, together, configured to prevent air-fuel mixtures ignited as flames from propagating therethrough. For instance, in relation to any combination of its cross-sectional shape, cross-sectional dimensions and the like, each quenching opening 136 may be configured to meet one or more maximum experimental safe gaps (or MESGs) for liquid fuel, including the maximum experimental safe gap for one, some or all of gasoline, diesel fuel, kerosene or the like. Relatedly, the flame mitigation device 112 is configured to prevent air-fuel mixtures ignited as flames from propagating past the flame mitigation device 112 through the quenching openings 136. Similarly, from the perspective of the portable fuel container 100, the flame mitigation device 112 is configured to prevent air-fuel mixtures ignited as flames from propagating into the fuel reservoir 104 through the access port 106 and past the flame mitigation device 112 through the quenching openings 136. Instead, the flame mitigation device 112 is configured to quench air-fuel mixtures ignited as flames on the way past the flame mitigation device 112 through the quenching openings 136, whereupon they become unignited air-fuel mixtures.

Among other things, it follows that using the flame mitigation device 112, the portable fuel container 100 is configured to prevent air-fuel mixtures ignited as flames about the access port 106 from igniting air-fuel mixtures in the fuel reservoir 104. For instance, if users ignore warnings and mishandle the portable fuel container 100 by bringing it near sources of flames, air-fuel mixtures in the spout 122, in the adaptor neck 108, in the flame mitigation device 112 or otherwise about the access port 106 might be ignited as flames. However, from its location in the fuel reservoir 104 behind the access port 106, the flame mitigation device 112 will prevent air-fuel mixtures about the access port 106, if ignited as flames, from propagating into the fuel reservoir 104 past the flame mitigation device 112 through the quenching openings 136. Instead, the flame mitigation device 112 will quench air-fuel mixtures about the access port 106, if ignited as flames, on the way past the flame mitigation device 112 through the quenching openings 136, whereupon they become unignited air-fuel mixtures before joining air-fuel mixtures in the fuel reservoir 104. Accordingly, the flame mitigation device 112 will prevent air-fuel mixtures about the access port 106, if ignited as flames, from igniting air-fuel mixtures in the fuel reservoir 104.

Figure 2A:
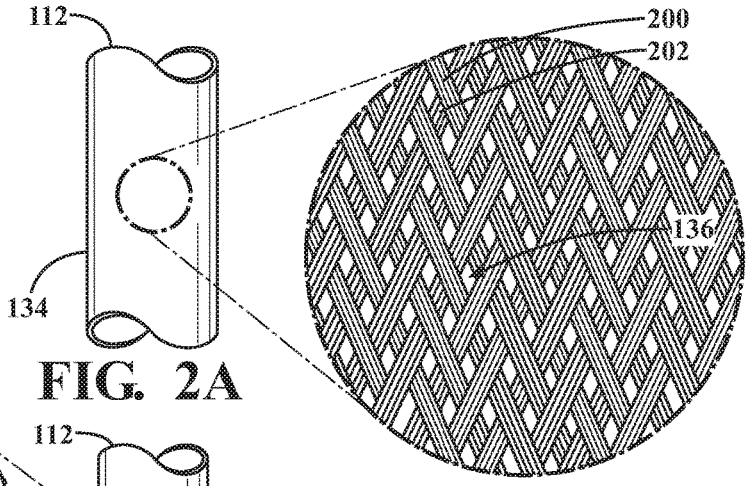
FIG. 2A is a schematic view of the flame mitigation device, showing the flame mitigation device having a woven construction, in relation to which the flame mitigation device includes interwoven warps and wefts, and interstitially defines quenching openings between the warps and the wefts configured to allow liquid fuel therethrough, but prevent air-fuel mixtures ignited as flames from propagating therethrough.

As shown with additional reference to FIG. 2A, the flame mitigation device 112, including along the mouth 130, along the sidewall 134 and at the bottom 132, has a woven construction, in relation to which, among other things, the flame mitigation device 112 defines the quenching openings 136. As part of the woven construction, the flame mitigation device 112 includes inelastically resiliently flexible interwoven warps 200 and wefts 202. The warps 200 and the wefts 202 are straightened, and have flattened cross-sectional shapes. For instance, as shown, one, some or all of the warps 200 and the wefts 202 include multiple (e.g., four) side-by-side inelastically resiliently flexible monofilament strands that individually have circular cross-sectional shapes and, by extension, together have flattened cross-sectional shapes.

The warps 200 and the wefts 202 are axially-oppositely helically oriented, and cross 4reach other at close to normal crossing angles. In association with their helical orientations, the warps 200 and the wefts 202 are inelastically resiliently flexed. Moreover, the warps 200 are spaced apart from one another, and the wefts 202 are spaced apart from one another. Relatedly, the warps 200 and the wefts 202 are interwoven where they cross each other, with the warps 200 being woven with the wefts 202, and the wefts 202 being woven with the warps 200.

Using the warps 200 and the wefts 202, the flame mitigation device 112 interstitially defines the quenching openings 136 therebetween, with each quenching opening 136 being defined between two adjacent warps 200 and two adjacent wefts 202. As interstitially defined between the warps 200 and the wefts 202, the quenching openings 136 open through the flame mitigation device 112 from between the warps 200 and the wefts 202, and have rhombic cross-sectional shapes, with the same or otherwise similar cross-sectional dimensions as one another. Relatedly, the quenching openings 136 are regularly arranged throughout the sidewall 134, including immediately leading from the mouth 130 and immediately leading from the bottom 132. Moreover, from the perspective of the flame mitigation device 112, the quenching openings 136 have relatively high numbers, and have a relatively high coverage density.

The flame mitigation device 112, including the warps 200 and the wefts 202, is made from one or more high-strength, durable, chemically fuel-resistant and flame-resistant polymeric materials. For instance, the flame mitigation device 112, including the warps 200 and the wefts 202, may be made from one or more thermoplastics suitable for weaving, such as polyethylene terephthalate (PET) or polybutylene terephthalate (PBT).

In one implementation of the woven construction, in relation to having a circular cross-sectional shape, the access port 106 has a diameter of approximately 1½ inches. Moreover, in relation to having an annular cross-sectional shape, with the same cross-sectional dimensions as the access port 106, the adaptor neck 108 has a diameter of approximately 1½ inches.

In this implementation of the woven construction, in relation to having the same or otherwise similar cross-sectional dimensions as the adaptor neck 108, the flame mitigation device 112, including along the mouth 130, along the sidewall 134 and at the bottom 132, has cross-sectional dimensions of approximately 1½ inches or less. Moreover, in relation to being elongate and trap-like, the flame mitigation device 112 has an overall length of approximately 6 inches and, in association therewith, has an inside depth of approximately 6 inches.

Along the mouth 130, in relation to having an annular cross-sectional shape, with the same cross-sectional dimensions as the adaptor neck 108, the flame mitigation device 112 has a diameter of approximately 1½ inches. The mouth 130 is set coaxially inside the adaptor neck 108 at a depth of approximately ¼ inch. At the bottom 132, in relation to having a pinched cross-sectional shape, the flame mitigation device 112 has a pinch distance of approximately 1½ inches or less. For instance, the flame mitigation device 112 may have a pinch distance of approximately 1⅖ inches. Along the sidewall 134, in relation to having a progressively narrowing oval cross-sectional shape, the flame mitigation device 112 has a major diameter and a relatively smaller minor diameter of approximately 1½ inches or less. For instance, the flame mitigation device 112 may have a major diameter of approximately 1½ inches, and a progressively narrowing minor diameter of approximately 1½ inches immediately leading from the mouth 130 to approximately 0 inches immediately leading from the bottom 132.

As part of the woven construction, the warps 200 are spaced apart from one another at a distance of approximately 1 millimeter or less, and the wefts 202 are spaced apart from one another at a distance of approximately 1 millimeter or less. For instance, the warps 200 may be spaced apart from one another at a distance between approximately ½ millimeter and approximately 1 millimeter inclusive, and the wefts 202 may be spaced apart from one another at a distance between approximately ½ millimeter and approximately 1 millimeter inclusive. Alternatively, for instance, the warps 200 may be spaced apart from one another at a distance between approximately ½ millimeter and approximately ¾ millimeter inclusive, and the wefts 202 may be spaced apart from one another at a distance between approximately ½ millimeter and approximately ¾ millimeter inclusive. Moreover, the warps 200 and the wefts 202 have widths the same or otherwise similar to the distance at which they are spaced apart from one another. Among other things, it follows that the warps 200 and the wefts 202 have widths of approximately 1 millimeter or less. For instance, the warps 200 and the wefts 202 may have widths between approximately ½ millimeter and approximately 1 millimeter inclusive. Alternatively, for instance, the warps 200 and the wefts 202 may have widths between approximately ½ millimeter and approximately ¾ millimeter inclusive.

Relatedly, the quenching openings 136 have cross-sectional dimensions of approximately 1 millimeter or less, including, in relation to having rhombic cross-sectional shapes, longest diagonals of approximately 1 millimeter or less. For instance, the quenching openings 136 may have cross-sectional dimensions between approximately ½ millimeter and approximately 1 millimeter inclusive, including, in relation to having rhombic cross-sectional shapes, longest diagonals between approximately ½ millimeter and approximately 1 millimeter inclusive. Alternatively, for instance, the quenching openings 136 may have cross-sectional dimensions between approximately ½ millimeter and approximately ¾ millimeter inclusive, including, in relation to having rhombic cross-sectional shapes, longest diagonals between approximately ½ millimeter and approximately ¾ millimeter inclusive.

Figure 2B:
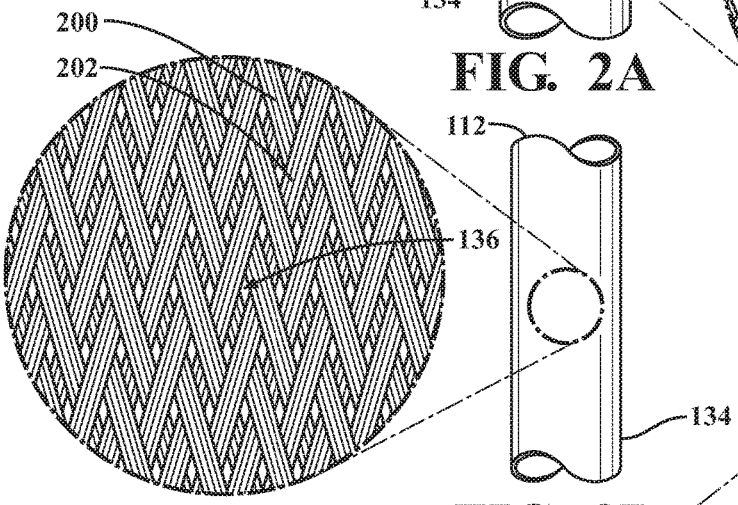
FIGS. 2B-2D are schematic views of the flame mitigation device, showing further aspects of the woven construction, in relation to which the flame mitigation device is elastically flexible.
Figure 2C:
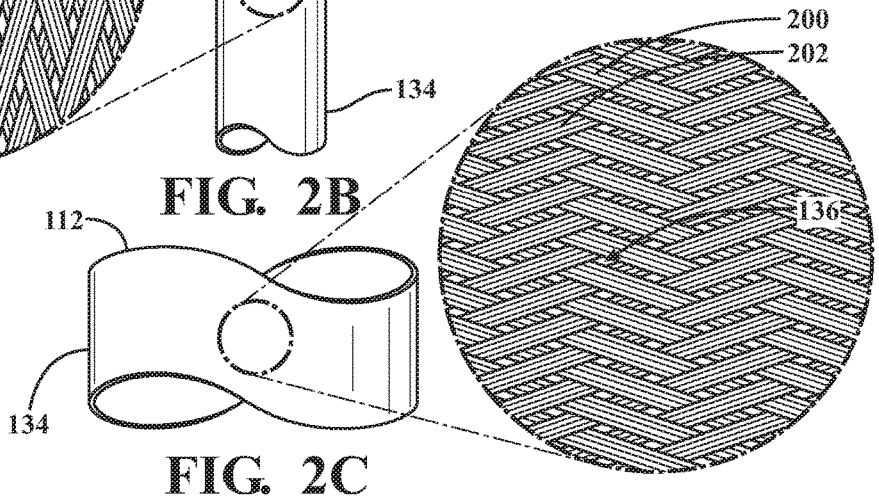
Figure 2D:
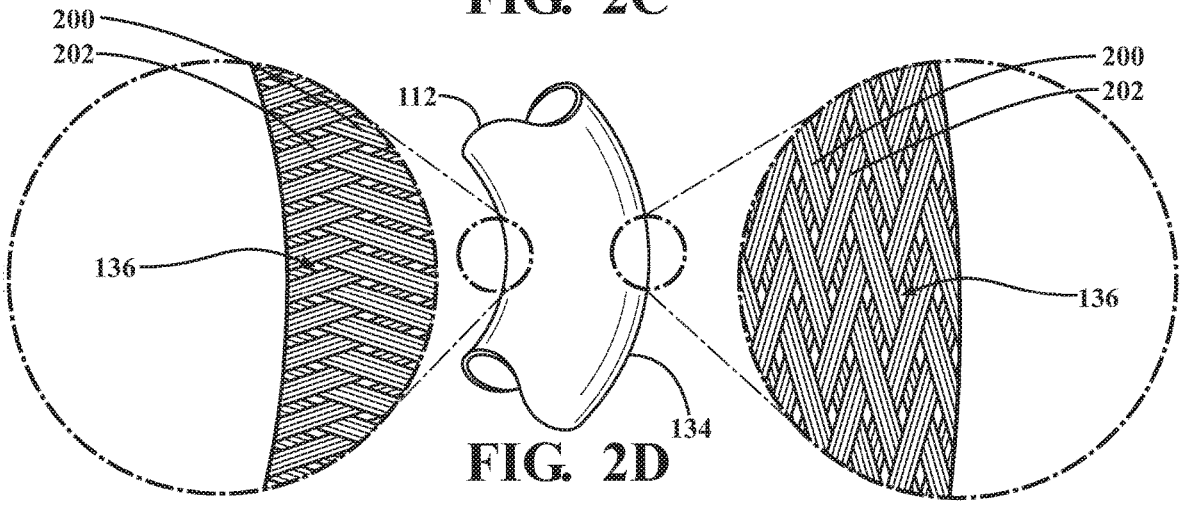

As shown with additional reference to FIGS. 2B-2D, in relation to the warps 200 and the wefts 202 being inelastically resiliently flexible, and at the same time, interwoven, the flame mitigation device 112 has an elastically flexible configuration. With the elastically flexible configuration, the flame mitigation device 112 is configured to hold its shape, but elastically flex under high load conditions, including manual manipulation. Specifically, absent manual manipulation or other high load conditions, the flame mitigation device 112, including along the sidewall 134, is configured to hold its shape. For instance, the flame mitigation device 112 is configured to hold its shape against gravity, liquid fuel and other environmental phenomena inherent in everyday use of the portable fuel container 100 under normal load conditions, including in association with any combination of picking up, holding, carrying, tipping, setting down and otherwise handling the portable fuel container 100. However, under manual manipulation or other high load conditions, the flame mitigation device 112, including along the sidewall 134, is configured to elastically flex, including any combination of elastically expand, elastically contract, elastically bend and the like. Thereafter, once again absent manual manipulation or other high load conditions, the flame mitigation device 112 is configured to spring back to and once again hold its shape.

In relation to holding its shape, as suspended from the adaptor neck 108 in the fuel reservoir 104 by the mouth 130, the flame mitigation device 112, including along the sidewall 134 and at the bottom 132, is configured to hold itself with an oblique orientation in-line with the adaptor neck 108. Moreover, the flame mitigation device 112 is configured to hold itself from having the sidewall 134 pinch. Moreover, the flame mitigation device 112, including along the sidewall 134, is configured to hold the quenching openings 136 open through the flame mitigation device 112.

As shown in FIG. 2A, with the flame mitigation device 112 holding its shape, the crossing angles at which the warps 200 and the wefts 202 cross each other are axially-biased narrower than normal. Accordingly, the quenching openings 136 are narrower than square. As shown in FIGS. 2B and 2C, the flame mitigation device 112, including along the sidewall 134, is configured to elastically expand with compelled counterpart elastic contraction. Relatedly, the quenching openings 136 are configured to have self-adjustable cross-sectional shapes and cross-sectional dimensions. Specifically, as shown in FIG. 2B, the flame mitigation device 112 is configured to elastically axially expand with compelled counterpart elastic radial contraction, whereupon the crossing angles, from narrower than normal, increasingly narrow. Accordingly, the quenching openings 136, from narrower than square, increasingly narrow to increasingly close through the flame mitigation device 112. Similarly, as shown in FIG. 2C, the flame mitigation device 112 is configured to elastically radially expand with compelled counterpart elastic axial contraction, whereupon the crossing angles, from narrower than normal, increasingly widen to normal, and thereafter, from normal, increasingly widen wider than normal. Accordingly, the quenching openings 136, from narrower than square, increasingly widen to square to increasingly open through the flame mitigation device 112, and thereafter, from square, increasingly widen wider than square to increasingly close through the flame mitigation device 112.

With the elastically flexible configuration, the flame mitigation device 112, including along the sidewall 134, is configured to elastically expand, including elastically expand with compelled counterpart elastic contraction, by a factor of 2 or more. Specifically, the flame mitigation device 112 is configured to elastically axially expand by a factor of 2 or more, and as the compelled counterpart thereto, elastically radially contract by a factor of 2 or more. For instance, the flame mitigation device 112 may be configured to elastically axially expand by a factor of 3, and as the compelled counterpart thereto, elastically radially contract by a factor of 3. Similarly, the flame mitigation device 112 is configured to elastically radially expand by a factor of 2 or more, and as the compelled counterpart thereto, elastically axially contract by a factor of 2 or more. For instance, the flame mitigation device 112 may be configured to elastically radially expand by a factor of 3, and as the compelled counterpart thereto, elastically axially contract by a factor of 3.

As shown in FIG. 2D, the flame mitigation device 112, including along the sidewall 134, is configured to elastically bend, whereupon the crossing angles at the outside of the bend, from narrower than normal, increasingly narrow, and the crossing angles at the inside of the bend, from narrower than normal, increasingly widen to normal, and thereafter, from normal, increasingly widen wider than normal. Accordingly, the quenching openings 136 at the outside of the bend, from narrower than square, increasingly narrow to increasingly close through the flame mitigation device 112. Moreover, the quenching openings 136 at the inside of the bend, from narrower than square, increasingly widen to square to increasingly open through the flame mitigation device 112, and thereafter, from square, increasingly widen wider than square to increasingly close through the flame mitigation device 112.

At the same time, as shown in FIGS. 2B-2D, with the quenching openings 136 having self-adjustable cross-sectional shapes and cross-sectional dimensions, the flame mitigation device 112, including along the sidewall 134, is configured to hold the quenching openings 136 open through the flame mitigation device 112 against elastic flexing, including any combination of elastic expansion, elastic contraction, elastic bending and the like. Specifically, the flame mitigation device 112 is configured to hold the quenching openings 136 from closing enough to prevent liquid fuel therethrough, and relatedly, past the flame mitigation device 112 through the quenching openings 136. Moreover, the flame mitigation device 112 is configured to hold the quenching openings 136 from opening enough to allow air-fuel mixtures ignited as flames from propagating therethrough, and relatedly, past the flame mitigation device 112 through the quenching openings 136.

One of the many advantages of the flame mitigation device 112 taught by this disclosure is user friendliness. Specifically, the flame mitigation device 112 helps offer users of the portable fuel container 100 the same experience that users of otherwise similar portable fuel containers without flame mitigation devices are accustomed to.

For instance, with the quenching openings 136 being regularly arranged throughout the sidewall 134, and in relation to any combination of their relatively high numbers, relatively high coverage density, cross-sectional shapes, cross-sectional dimensions and the like, the quenching openings 136 are not obstructive to the fluid passageway defined by the portable fuel container 100 between the fuel reservoir 104 and the exterior 102. Specifically, for purposes of dispensing liquid fuel from the fuel reservoir 104, the quenching openings 136 have proven in testing to being configured to allow liquid fuel being dispensed from the fuel reservoir 104 through the access port 106 and through the spout 122 therethrough without added restriction. Relatedly, the flame mitigation device 112 has proven in testing to being configured to allow liquid fuel being dispensed from the fuel reservoir 104 through the access port 106 and through the spout 122 past the flame mitigation device 112 through the quenching openings 136 without added restriction. Moreover, for purposes of filling the fuel reservoir 104 with liquid fuel, the quenching openings 136 have proven in testing to being configured to allow liquid fuel being dispensed inside the flame mitigation device 112 by standard fuel pump nozzles therethrough without backsplash or other backup. Relatedly, the flame mitigation device 112 has proven in testing to being configured to allow liquid fuel being dispensed inside the flame mitigation device 112 by standard fuel pump nozzles past the flame mitigation device 112 through the quenching openings 136 without backsplash or other backup.

Also for purposes of filling the fuel reservoir 104 with liquid fuel, and in relation to the elastically flexible configuration, the flame mitigation device 112 is configured to elastically flex in association with accepting standard fuel pump nozzles into the fuel reservoir 104 inside the flame mitigation device 112. For instance, the flame mitigation device 112 will elastically axially expand to accommodate accepting standard fuel pump nozzles further into the fuel reservoir 104 than the inside depth of the flame mitigation device 112 would otherwise allow. Moreover, the flame mitigation device 112 will elastically radially expand to accommodate accepting standard fuel pump nozzles with relatively larger cross-sectional dimensions into the fuel reservoir 104. Moreover, the flame mitigation device 112 will elastically bend to accommodate accepting curved standard fuel pump nozzles into the fuel reservoir 104. Additionally, or alternatively, the flame mitigation device 112 will elastically bend to accommodate accepting standard fuel pump nozzles into the fuel reservoir 104 other than in-line with the adaptor neck 108.

Another advantage of the flame mitigation device 112 taught by this disclosure is manufacturability. For instance, in relation to the woven construction, the flame mitigation device 112 may be cost-effectively fashioned from a simple woven tubular blank. As the precursor from which the flame mitigation device 112 and the woven construction is born, the blank has the same or otherwise similar cross-sectional dimensions as the adaptor neck 108, and the same woven construction as the flame mitigation device 112, including being made from thermoplastics. Along its length, the blank includes an open first end and an opposing open second end. To fashion the flame mitigation device 112 from the blank, the first end is left open to form the mouth 130, the second end is permanently pinched closed to form the bottom 132, and the intermediate remainder is left to form the sidewall 134. For instance, the second end may be radially pinched and, in association therewith, sonic welded, or otherwise locally melted and cooled, to fuse opposing circumferential halves thereof together into a seam.

Moreover, the flame mitigation device 112 is straightforwardly installable to the otherwise assembled portable fuel container 100. Specifically, the flame mitigation device 112, leading with the bottom 132, may be inserted into the fuel reservoir 104 through the adaptor neck 108 to the point where the mouth 130 is coaxially inside the adaptor neck 108. From its location coaxially inside the adaptor neck 108, the mouth 130 may be either elastically radially expanded or elastically radially contracted to assume the same cross-sectional dimensions as the adaptor neck 108. Thereafter, the mouth 130 may be radially pressed against the adaptor neck 108 and, in association therewith, either the adaptor neck 108 or the mouth 130, or both, may be locally sonic welded, or otherwise locally melted and cooled, to fuse them together circumferentially around the adaptor neck 108 into a joint. At this point, with the flame mitigation device 112 configured to hold its shape, there is no need for the flame mitigation device 112 to be otherwise supported by the remainder of the portable fuel container 100. Accordingly, the assembly of the portable fuel container 100 is complete in relation to the flame mitigation device 112.

Figure 3A:
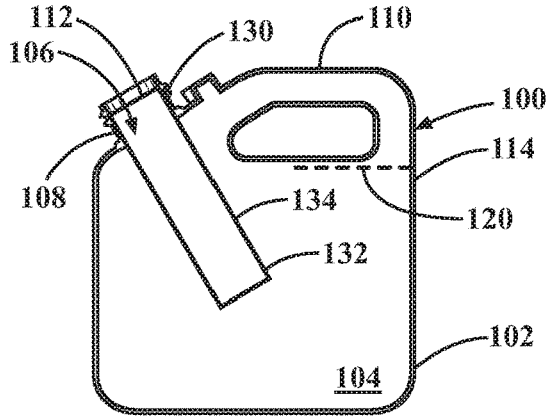
FIGS. 3A-3C are cross-sectional views of the portable fuel container, showing the portable fuel container including the same flame mitigation device regardless of its capacity.
Figure 3B:
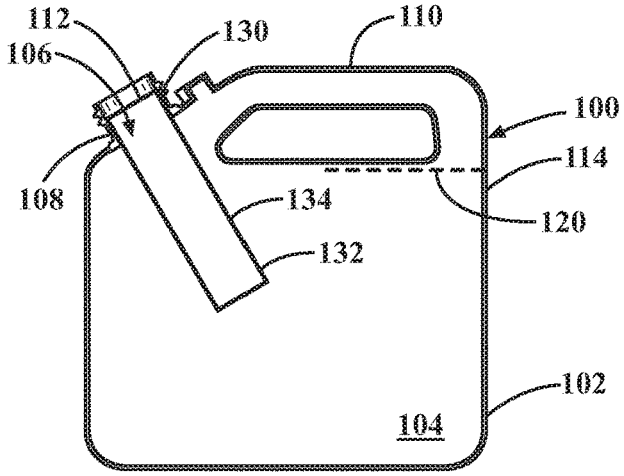
Figure 3C:
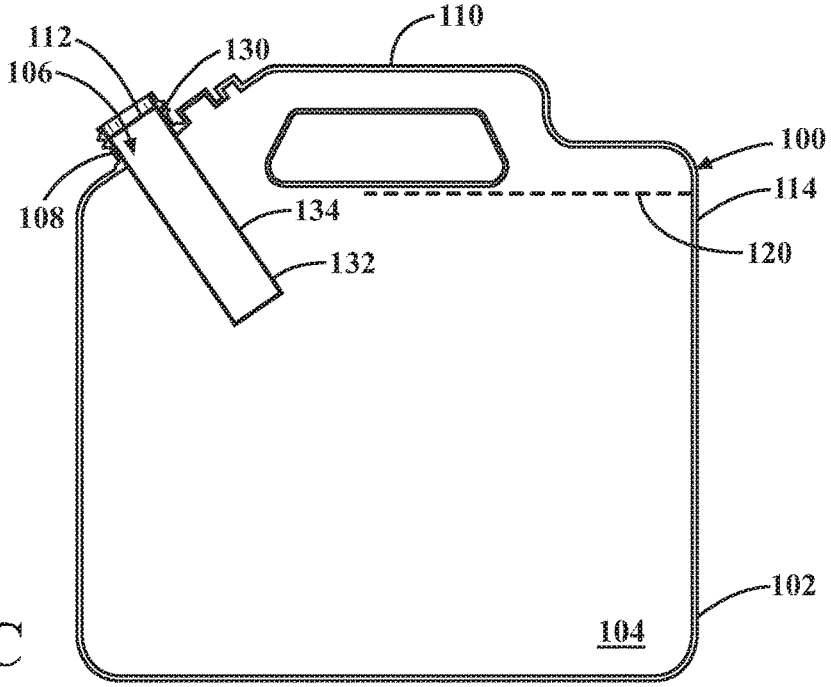

Relatedly, as shown in FIGS. 3A-3C, in relation to the quenching openings 136 not being obstructive to the fluid passageway defined by the portable fuel container 100 between the fuel reservoir 104 and the exterior 102, the portable fuel container 100 may include the same flame mitigation device 112 regardless of its capacity. For instance, regardless of whether the portable fuel container 100 has a one gallon capacity, as shown in FIG. 3A, has a two gallon capacity, as shown in FIG. 3B, or has a five gallon capacity, as shown in FIG. 3C, the portable fuel container 100 includes the same flame mitigation device 112.

Another advantage of the flame mitigation device 112 taught by this disclosure is that despite its advantageous user friendliness and advantageous manufacturability, basic performance requirements are not compromised. For instance, in relation to any combination of their cross-sectional shapes, cross-sectional dimensions and the like, the quenching openings 136 have proven in testing to being configured to prevent air-fuel mixtures ignited as flames from propagating therethrough. Relatedly, the flame mitigation device 112 has proven in testing to being configured to prevent air-fuel mixtures ignited as flames from propagating past the flame mitigation device 112 through the quenching openings 136. Similarly, from the perspective of the portable fuel container 100, the flame mitigation device 112 has proven in testing to being configured to prevent air-fuel mixtures ignited as flames from propagating into the fuel reservoir 104 through the access port 106 and past the flame mitigation device 112 through the quenching openings 136, including from jetting past the flame mitigation device 112 through the quenching openings 136 when the portable fuel container 100 is mishandled by jolting it.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A portable fuel container, comprising:

a fuel reservoir and an access port therefor; and an elongate flame mitigation device in the fuel reservoir behind the access port, the flame mitigation device including an open mouth sealed around the access port, a closed bottom opposing the mouth, and an intermediate tubular sidewall, and having a woven construction, in relation to which the flame mitigation device includes inelastically resiliently flexible interwoven warps and wefts, interstitially defines quenching openings between the warps and the wefts configured to allow liquid fuel therethrough, but prevent air-fuel mixtures ignited as flames from propagating therethrough, and is elastically flexible to hold its shape, but elastically flex under manual manipulation.

2. The portable fuel container of claim 1, wherein the flame mitigation device is suspended in the fuel reservoir by the mouth, and is elastically flexible to hold itself with an oblique orientation and hold itself from having the sidewall pinch.

3. The portable fuel container of claim 1, wherein the flame mitigation device is suspended in the fuel reservoir by the mouth, and is elastically flexible to hold the quenching openings open.

4. The portable fuel container of claim 1, wherein the flame mitigation device is elastically flexible to elastically flex while holding the quenching openings thereagainst from closing enough to prevent liquid fuel therethrough, or opening enough to allow air-fuel mixtures ignited as flames from propagating therethrough.

5. The portable fuel container of claim 1, wherein the flame mitigation device is elastically flexible to elastically expand by a factor of 2 or more.

6. The portable fuel container of claim 1, wherein the flame mitigation device is elastically flexible to elastically bend.

7. The portable fuel container of claim 1, wherein the flame mitigation device is irremovable.

8. The portable fuel container of claim 1, wherein the flame mitigation device has an annular cross-sectional shape along the mouth, a progressively narrowing oval cross-sectional shape along the sidewall, and a pinched cross-sectional shape at the bottom.

9. The portable fuel container of claim 1, wherein the flame mitigation device is fashioned from a woven tubular blank, with a first end left open to form the mouth, a second end permanently pinched closed to form the bottom, and an intermediate remainder left to form the sidewall.

10. The portable fuel container of claim 1, wherein the warps and the wefts are straightened, and have flattened cross-sectional shapes.

11. A portable fuel container, comprising:

a fuel reservoir and an access port therefor;

an adaptor neck around the access port, the adaptor neck extending from the fuel reservoir with an oblique orientation; and an elongate flame mitigation device in the fuel reservoir behind the access port, the flame mitigation device including an open mouth coaxially inside the adaptor neck and permanently connected thereto circumferentially therearound, by which the flame mitigation device is suspended in the fuel reservoir in-line with the adaptor neck, a closed bottom opposing the mouth, and an intermediate tubular sidewall, and having a woven construction, in relation to which the flame mitigation device includes straightened inelastically resiliently flexible interwoven warps and wefts having flattened cross-sectional shapes, interstitially defines quenching openings between the warps and the wefts configured to allow liquid fuel therethrough, but prevent air-fuel mixtures ignited as flames from propagating therethrough, and is elastically flexible to hold itself in-line with the adaptor neck, hold itself from having the sidewall pinch and hold the quenching openings open, but elastically expand and elastically bend under manual manipulation while holding the quenching openings thereagainst from closing enough to prevent liquid fuel therethrough, or opening enough to allow air-fuel mixtures ignited as flames from propagating therethrough.

12. The portable fuel container of claim 11, wherein the flame mitigation device is elastically flexible to elastically expand with compelled counterpart elastic contraction.

13. The portable fuel container of claim 11, wherein the flame mitigation device is elastically flexible to elastically expand with compelled counterpart elastic contraction by a factor of 2 or more.

14. The portable fuel container of claim 11, wherein the flame mitigation device has an annular cross-sectional shape along the mouth, a progressively narrowing oval cross-sectional shape along the sidewall, and a pinched cross-sectional shape at the bottom.

15. The portable fuel container of claim 11, wherein the flame mitigation device is fashioned from a woven tubular blank, with a first end left open to form the mouth, a second end permanently pinched closed to form the bottom, and an intermediate remainder left to form the sidewall.

16. The portable fuel container of claim 11, wherein the warps and the wefts include multiple side-by-side inelastically resiliently flexible monofilament strands that individually have circular cross-sectional shapes, and together have flattened cross-sectional shapes.

17. A flame mitigation device for a portable fuel container, comprising:

a woven construction born from a precursor woven tubular blank, the blank including inelastically resiliently flexible interwoven warps and wefts; wherein as fashioned into the flame mitigation device, the blank is left open at a first end to form a mouth having an annular cross-sectional shape, is permanently pinched closed at a second end to form a bottom having a pinched cross-sectional shape, and is left at an intermediate remainder to form a sidewall having a progressively narrowing oval cross-sectional shape; and in relation to the woven construction, the flame mitigation device includes the warps and the wefts, interstitially defines quenching openings between the warps and the wefts configured to allow liquid fuel therethrough, but prevent air-fuel mixtures ignited as flames from propagating therethrough, and is elastically flexible to hold its shape, but elastically flex under manual manipulation.

18. The flame mitigation device of claim 17, wherein the flame mitigation device is elastically flexible to elastically flex while holding the quenching openings thereagainst from closing enough to prevent liquid fuel therethrough, or opening enough to allow air-fuel mixtures ignited as flames from propagating therethrough.

19. The flame mitigation device of claim 17, wherein the flame mitigation device is elastically flexible to elastically radially expand by a factor of 2 or more, and as a compelled counterpart thereto, elastically axially contract by a factor of 2 or more.

20. The flame mitigation device of claim 17, wherein the warps and the wefts are straightened, and have flattened cross-sectional shapes.

* * * * *